US006183699B1

(12) United States Patent
Lomas

(10) Patent No.: US 6,183,699 B1
(45) Date of Patent: Feb. 6, 2001

(54) FCC APPARATUS WITH SHORT PRIMARY CONTACTING AND CONTROLLED SECONDARY CONTACTING

(75) Inventor: David A. Lomas, Barrington, IL (US)

(73) Assignee: UOP LLC, Des Plaines, IL (US)

( * ) Notice: Under 35 U.S.C. 154(b), the term of this patent shall be extended for 0 days.

(21) Appl. No.: 09/336,236

(22) Filed: Jun. 18, 1999

Related U.S. Application Data

(62) Division of application No. 08/985,987, filed on Dec. 5, 1997, now Pat. No. 5,965,012.

(51) Int. Cl.[7] ..... B01J 8/18; F27B 15/08

(52) U.S. Cl. ..... 422/145; 422/144; 422/147; 422/223

(58) Field of Search ..... 422/145, 144, 422/147, 223, 219, 146

(56) References Cited

U.S. PATENT DOCUMENTS

| | | | |
|---|---|---|---|
| 2,451,619 | 10/1948 | Hengstebeck et al. | 196/52 |
| 3,679,576 | 7/1972 | McDonald | 208/74 |
| 3,821,103 | 6/1974 | Owen et al. | 208/72 |
| 3,846,280 | 11/1974 | Owen et al. | 208/120 |
| 3,888,762 | 6/1975 | Gerhold | 208/120 |
| 4,035,284 | 7/1977 | Gross et al. | 208/120 |
| 4,397,738 | 8/1983 | Kemp | 208/161 |
| 4,419,221 | 12/1983 | Castagnos, Jr. et al. | 208/113 |
| 4,752,377 | 6/1988 | York et al. | 208/113 |
| 4,859,313 | 8/1989 | Lengemann et al. | 280/113 |
| 4,883,583 | 11/1989 | Mauleon et al. | 280/113 |
| 4,960,503 | 10/1990 | Haun et al. | 208/85 |
| 4,985,136 | 1/1991 | Bartholic | 208/153 |
| 5,017,343 | 5/1991 | Cetinkaya | 422/140 |
| 5,296,131 | 3/1994 | Raterman | 208/113 |
| 5,346,613 | 9/1994 | Lomas et al. | 208/164 |
| 5,451,313 | 9/1995 | Wegerer et al. | 208/164 |
| 5,462,652 | 10/1995 | Wegerer | 208/167 |
| 5,858,207 | 1/1999 | Lomas | 208/113 |

*Primary Examiner*—Shrive Beck
*Assistant Examiner*—Susan Ohorodnik
(74) *Attorney, Agent, or Firm*—John G. Tolomei; James C. Paschall

(57) ABSTRACT

An FCC process combines ultra short catalyst and feed contacting with the blending of spent and regenerated catalyst in a disengaging vessel that recovers a primary product and passes the separated catalyst to a riser for controlled cracking of the adsorbed heavier hydrocarbons. The disengaging vessel is used as a separation zone to quickly withdraw lighter products that are initially cracked and the riser is used for the remaining hydrocarbons as a controlled secondary cracking section to further convert heavier feed components that are not quickly displaced from the catalyst in the blending/disengaging vessel zone. A separate feed may be added riser downstream of the blending disengaging vessel for cracking of secondary feeds. The arrangement provides a great deal of flexibility in the operation of ultra short catalyst contact systems.

6 Claims, 2 Drawing Sheets

FCC APPARATUS WITH SHORT PRIMARY CONTACTING AND CONTROLLED SECONDARY CONTACTING

CROSS-REFERENCE TO RELATED APPLICATION

This application is a Divisional application of Ser. No. 08/985,987 filed Dec. 5, 1997, now U.S. Pat. No. 5,965,012, the contents of which are hereby incorporated by reference.

BACKGROUND OF THE INVENTION

1. Field of the Invention

This invention relates to the fluidized catalytic cracking (FCC) conversion of heavy hydrocarbons into lighter hydrocarbons with a fluidized stream of catalyst particles and regeneration of the catalyst particles to remove coke which acts to deactivate the catalyst. More specifically, this invention relates to feed and catalyst contacting.

2. Description of the Prior Art

Catalytic cracking is accomplished by contacting hydrocarbons in a reaction zone with a catalyst composed of finely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to generally by those skilled in the art as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, for transporting catalyst between reaction and regeneration zones, and for combusting coke in the regenerator are well known by those skilled in the art of FCC processes. To this end, the art is replete with vessel configurations for contacting catalyst particles with feed and regeneration gas, respectively.

Despite the long existence of the FCC process, techniques are continually sought for improving product recovery both in terms of product quantity and composition, i.e. yield and selectivity. Two facets of the FCC process that have received attention are recovery of adsorbed products from the spent FCC catalyst and initial contacting of the FCC feed with the regenerated catalyst. Improvement in the recovery of hydrocarbons from spent catalyst directly improves yields while better initial feed and catalyst contacting tends to benefit yield and selectivity.

One direct way of recovering additional products is by more complete stripping of hydrocarbons from the spent catalyst. More complete stripping removes hydrocarbons from the catalyst that are lost by combustion when the spent catalyst enters the regeneration zone. Common methods to more completely strip catalyst raise the temperature of the spent catalyst in the stripping zone as a means of desorbing hydrocarbons from spent catalyst prior to regeneration. One system for heating spent catalyst in the stripping zone employs indirect heat transfer. A more common method of heating spent catalyst in the stripping zone mixes higher temperature regenerated catalyst with the spent catalyst in the stripping zone. U.S. Pat Nos. 3,821,103 and 2,451,619 describe systems for direct heating of spent catalyst with hot regenerated catalyst.

A variety of devices and piping arrangements have been employed to initially contact catalyst with feed. U.S. Pat. No. 5,017,343 is representative of devices that attempt to improve feed and catalyst contacting by maximizing feed dispersion. Another approach to improved feed and catalyst contacting is to increase the penetration of the feed into a flowing stream of catalyst. U.S. Pat. No. 4,960,503 exemplifies this approach where a plurality of nozzles surround an FCC riser to shoot feed into a moving catalyst stream from a multiplicity of discharge points. While these methods do improve distribution of the feed into the hot regenerated catalyst stream, there is still a transitory period of poor distribution when the relatively small quantities of the hydrocarbon feed disproportionately contact large quantities of hot catalyst. This poor thermal distribution results in non-selective cracking and the production of low value products such as dry gas.

The processing of increasingly heavier feeds and the tendency of such feeds to elevate coke production and yield undesirable products has led to new methods of contacting FCC feeds with catalyst. Recently methods of contacting FCC catalyst for very short contact periods have been of particular interest. U.S. Pat. No. 4,985,136 the contents of which are hereby incorporated by reference discloses an ultra short contact time for the fluidized catalytic cracking process that contacts an FCC feed with a falling curtain of catalyst for a contact time of less than 1 second followed by a quick separation. U.S. Pat. No. 5,296,131 the contents of which are hereby incorporated by reference discloses a similar ultra short contact time process that uses an alternate falling catalyst curtain and separation arrangement. The ultra short contact time system improves selectivity to gasoline while decreasing coke and dry gas production by using high activity catalyst that contacts the feed for a relatively short period of time. The inventions are specifically directed to zeolite catalysts having high activity. The short contact time arrangements permit the use of much higher zeolite content catalysts that increase the usual 25–30% zeolite contents of the FCC catalyst to amounts as high as 40–60% zeolite in the cracking catalyst. These references teach that shorter hydrocarbon and catalyst contact time is compensated for by higher catalyst activity. One drawback of most short contact time systems is the continued cracking of hydrocarbons that remain adsorbed or entrained with the catalyst after the initial stage of short contacting. These entrained and adsorbed hydrocarbons remain in a dense bed for long periods of time that can promote overcracking.

Another method that has been used to vary the contacting of feed with catalyst is the blending of spent and regenerated catalyst. U.S. Pat. No. 5,346413 issued to Lomas describes a method of blending spent catalyst with regenerated to increase the total catalyst to oil ratio and reduce the temperature of the catalyst blend. U.S. Pat. No. 5,462,652 issued to Wegerer uses a mixture of spent and regenerated catalyst to contact catalyst in an ultra short contact time arrangement. However, the hydrocarbons that remain on the catalyst again experience long residence time in a dense catalyst bed that still creates the problem of over cracking.

An additional limitation of ultra-short contacting system is their limited flexibility in feed contacting. Ultra-short contacting provides one type of contacting that may not be the optimal cracking regime for all feeds. Present arrangements for ultra short feed contacting cannot be altered to provide longer contact times when such contacting would be desirable for certain feeds.

Improved methods are sought for disbursing feed within the catalyst stream while avoiding localized overheating of the feed and for achieving thermal equilibrium between the relatively hotter catalyst and the relatively cooler feed. Such methods would reduce the localized overheating of the feed or the severity of the feed heating caused by the large temperature differentials between the feed and the catalyst which both contribute to feed over cracking while also avoiding or reducing the overcracking of entrained and adsorbed hydrocarbons. It would also be desirable to have an apparatus and process that is readily adaptable to providing ultra short feed contacting and longer transport conduit cracking.

It is an object of this invention to improve the control of cracking reaction time for light readily cracked hydrocarbons and more refractory heavy hydrocarbons.

Another object of this invention is to provide initial ultra short contacting of the feedstream followed by transport conduit cracking of adsorbed or entrained hydrocarbons.

It is a further object of this invention that to alternately or simultaneously provide ultra short catalyst contacting of product and traditional upflow or downflow contacting of hydrocarbon and feed in a catalyst transport conduit.

SUMMARY OF THE INVENTION

This invention is an FCC process that combines an ultra short catalyst and feed contacting stage for initial cracking of readily crackable hydrocarbons with transport conduit cracking, of adsorbed or entrained hydrocarbons in which both cracking stages can use a blend of carbonized and regenerated catalyst. The initial stage of ultra short contacting between the catalyst and the hydrocarbons provides the benefits of initial short duration catalyst contacting. Recycling of carbonized catalyst for ultra short contact time with the regenerated catalyst and the feed adds flexibility by allowing the catalyst to oil ratio to be increased and the temperature and activity of the catalyst to be controlled for this short duration contacting. After an initial short duration contact with the feed a disengaging vessel provides a fast separation of the readily cracked products from the catalyst that now contain relatively heavier hydrocarbons that have been adsorbed onto the catalyst. A transport conduit having an inlet at the bottom of the disengaging vessel withdraws catalyst from the disengaging vessel for further cracking of hydrocarbons in the conduit. The heavier adsorbed and entrained hydrocarbons will travel in essentially plug flow through the riser for an extended, but controlled period of secondary catalytic cracking. Secondary vapors are again rapidly disengaged from the catalyst to prevent over cracking. A stripper removes a majority of any adsorbed or entrained hydrocarbons from the spent catalyst that leave the riser. After stripping, spent catalyst returns to the regeneration zone, and a portion may be returned to provide carbonized catalyst for feed contacting. The carbonized catalyst that is blended with regenerated catalyst for the ultra short contacting can be supplied from the disengaging vessel or the stripping zone. Feed may be alternately injected initially into the process via the ultra-short feed contacting nozzle or initially into the transport reaction zone to only effect a single stage of longer duration feed contacting. The transport reaction zone can also be used a means of cracking a secondary feed that initially enters only the transport reaction zone and is in addition to a primary feed that first enter the process via the ultra short contacting zone.

An essential part of this invention is the recycling of catalyst that has passed through the FCC reaction zone to moderate the temperature of the regenerated catalyst. In this manner the invention uses circulation of catalyst that is generally referred to as "carbonized catalyst" and regenerated catalyst to reduce the severity and to improve the dispersion of feed and catalyst contacting by combining spent and regenerated catalyst in a manner to more effectively control catalyst activity temperature. The term "carbonized catalyst" refers to regenerated catalyst that has had at least some contact with a feed to deposit coke on the catalyst. Carbonized catalyst is usually referred to as "spent catalyst". However, spent catalyst is often thought of as originating from an FCC stripper. Accordingly, the term "carbonized catalyst" has been used in this application since the source of the carbonized catalyst will include the disengaging vessel as well as a stripping zone. In addition, the carbonized catalyst retains activity, and therefore the term "spent catalyst" while generally accepted—is misdescriptive. It is the intention of this invention to more fully utilize this remaining activity of what is herein termed carbonized catalyst by returning it to the reaction zone without regeneration.

The blending of carbonized and regenerated catalyst can provide ancillary advantages to the process. By the introduction of a stripping gas into the blending vessel, it can operate as a hot stripper to remove additional hydrocarbons from the blended catalyst which would otherwise enter the regeneration zone and inert gases from the regenerated catalyst that enters the transport conduit reaction zone from the disengaging vessel. Combining both regenerated and carbonized catalyst in the ultra short contacting zone and the disengaging vessel increases the solids to feed ratio in the reaction zone. A greater solids ratio improves catalyst and feed contacting. Since the recycle catalyst still has activity, the ratio of effective catalyst to oil is increased. Moreover, the larger the quantity of catalyst contacting the feed the more evenly and quickly distributes the heat to the feed.

The presence of coke on the catalyst can also benefit the process by reducing undesirable catalytic cracking reactions. The undesirable bimolecular reactions occur at highly acidic sites on the catalyst that are present on the fully regenerated catalyst. These sites strongly attract the hydrocarbon and are rapidly deactivated by coke accumulation. As subsequent recirculation passes coke particles through multiple cycles of feed contact without regeneration, these non-selective sites remain covered with catalyst so that only the more selective cracking sites remain active on the catalyst. The circulation of more selective sites can improve the yield of more desirable products.

The blending of catalyst is particularly suited for short contact time reaction systems. Under short contact time conditions the catalyst and feed are kept in contact for very short periods of time and then quickly separated so that the catalyst undergoes little activation. Therefore, this invention will facilitate the recirculation of large quantities of carbonized catalyst to the reaction zone without regeneration. The more feed and contact times are reduced, less deactivation will occur on the catalyst particles. Thus, in a short contact time arrangement it may be desirable to recycle 10, 20 or more parts of carbonized catalyst for each part of regenerated catalyst.

Accordingly, this invention is a process for the fluidized catalytic cracking of a hydrocarbon-containing stream. The process blends a mixture of carbonized and regenerated catalyst in a first standpipe conduit to produce a blended catalyst mixture. The blended catalyst mixture drops onto the feedstream to crack hydrocarbons in the feedstream and deposit coke and hydrocarbons on the catalyst in the blended catalyst mixture. The feedstream carries the catalyst immediately into a disengaging vessel. Cracked hydrocarbons disengage from the blended catalyst in the disengaging vessel and are withdrawn as a first product stream from an upper part of the disengaging vessel. A first catalyst recycle stream separated from the first product stream returns to the disengaging vessel. At least a portion of the catalyst from the disengaging vessel passes into a contacting conduit to effect further catalytic cracking of the hydrocarbons deposited on the catalyst and to produce a second product stream and spent catalyst. A stripping zone strips hydrocarbons from the spent catalyst. After stripping, a portion of the spent catalyst passes to a regeneration zone to provide the regenerated catalyst.

In another process embodiment, this invention is a process for the catalytic cracking of a relatively heavy FCC feedstock and a relatively light FCC feedstock. In the process, a light FCC feedstock passes into contact with a blended catalyst mixture comprising regenerated catalyst and carbonized catalyst to crack hydrocarbons in the first feedstock and deposit coke and hydrocarbons on the blended catalyst. A disengaging vessel separates most of the blended catalyst mixture from the light feedstock for the withdrawal of the first product stream from an upper portion of the disengaging vessel. Blended catalyst from a lower portion of the disengaging vessel passes into a contacting conduit. The heavy feedstock contacts the blended catalyst in the contacting conduit to crack hydrocarbons and produce a second product stream and spent catalyst by depositing coke and hydrocarbons on the blended catalyst. Spent catalyst separated from the second product stream undergoes stripping. After stripping, at least a portion of the spent catalyst passes to a regeneration zone to produce regenerated catalyst. Blending regenerated catalyst with at least a portion of the spent catalyst from the disengaging zone provides the blended catalyst mixture.

In an apparatus embodiment, this invention comprises a disengaging vessel having a first diameter that defines a primary feed inlet in its side wall and a riser conduit as an inlet in communication with the interior of the disengaging vessel at one end and an outlet at its opposite end. The riser conduit has a second diameter that is smaller than the first diameter and the riser inlet is located below the primary feed inlet. A riser inlet nozzle located proximate to the riser inlet provides gas thereto. A regeneration vessel communicates with a first standpipe conduit to supply regenerated catalyst to the primary feedstream inlet. Means are provided for mixing regenerated catalyst from the first standpipe conduit with carbonized catalyst and for injecting the mixture of regenerated and carbonized catalyst along with a primary feedstream into the primary feed inlet. The disengaging vessel defines a primary product outlet located above the primary feed inlet. A first separator receives the primary product stream from the disengaging vessel, separates spent catalyst from the primary product stream, and returns spent catalyst to the disengaging vessel via a first recycle conduit. The second separator receives a secondary product stream from the riser and separates the spent catalyst from the secondary product stream. Spent catalyst passes to a stripping vessel. A second standpipe conduit passes spent catalyst from the stripping vessel to the disengaging vessel. Means are provided for passing spent catalyst to the regenerator to regenerate the catalyst particles.

Additional objects, embodiments, and details of this invention will become apparent from the following detailed description.

DETAILED DESCRIPTION OF THE INVENTION

Figure 1:
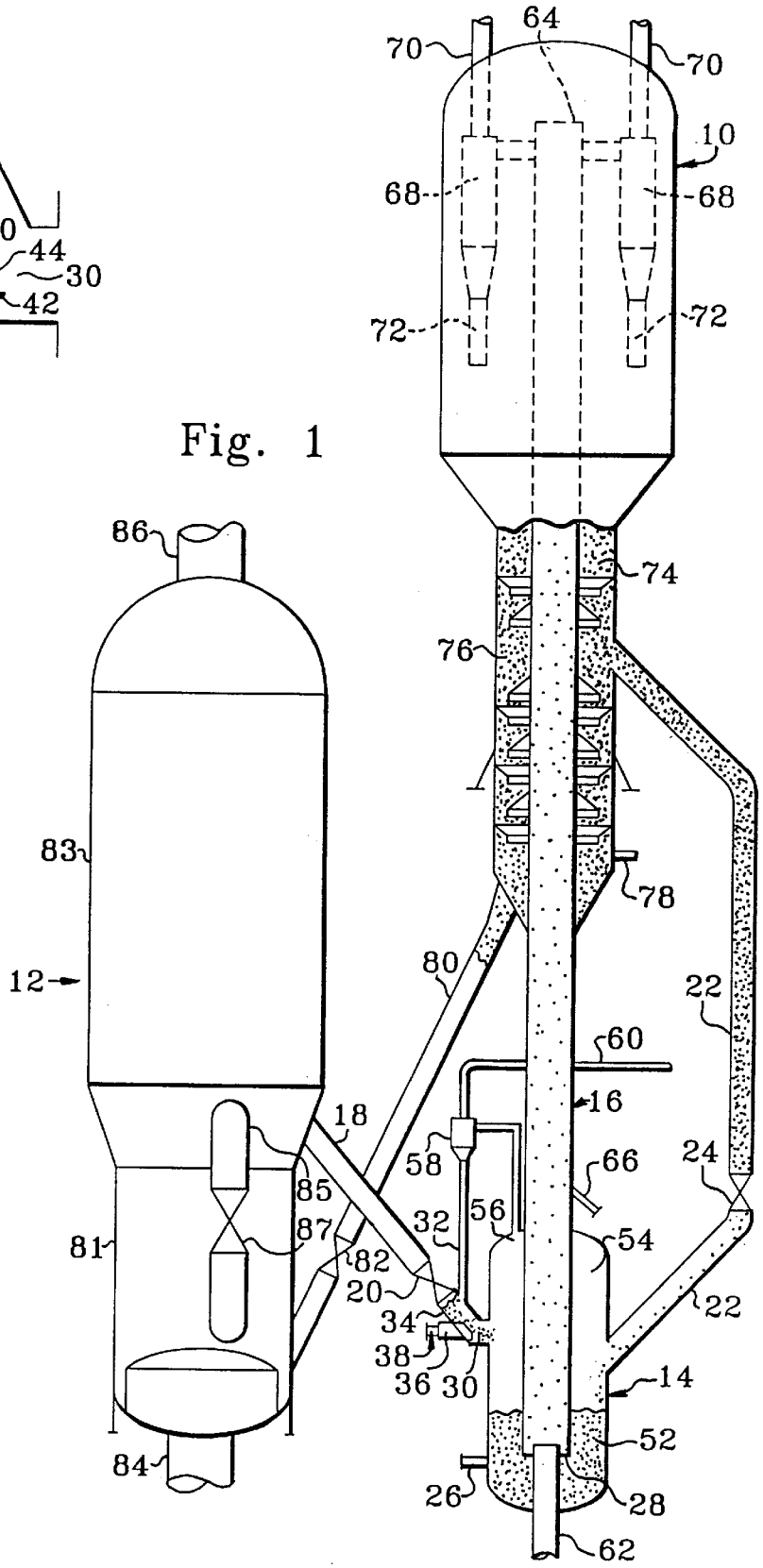
FIG. 1 is an elevation view showing an FCC regenerator and a schematic cross section of an FCC reactor arranged in accordance with this invention.

This invention is more fully explained in the context of an FCC process. FIG. 1 shows a typical schematic view of an FCC unit arranged in accordance with this invention. The description of this invention in the context of the specific process arrangement shown is not meant to limit it to the details disclosed therein. The FCC arrangement shown in FIG. 1 consists of a reactor 10, a regenerator 12, a disengaging vessel 14, and an elongate riser reaction zone 16 that provides a conversion zone that pneumatically conveys catalyst and feed. The arrangement circulates catalyst and contacts feed in the manner hereinafter described.

The catalyst used in this invention can include any of the well-known catalysts that are used in the art of fluidized catalytic cracking. These compositions include amorphous-clay type catalysts which have, for the most part, been replaced by high activity, crystalline alumina silica or zeolite containing catalysts. Zeolite containing catalysts are preferred over amorphous-type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, alumina, or zirconium. These catalyst compositions may have a zeolite content of 30% or more. ZSM-5 type catalysts are particularly preferred since the high coke selectivity of these catalyst will tend to preserve active sites as coke-containing catalyst makes multiple passes through the riser and thereby maintain overall activity.

In addition to catalyst, this invention may benefit from the circulation of inert particulate material. Recirculating solids on the reaction side of the process without regeneration will raise the level of coke on solids and can result in excessive regenerator temperature. Adding an inert material will decrease the average coke on solids ratio for material entering the regenerator without affecting the solids to oil ratio on the reactor side of the process. In this manner the inert material acts as a heat sink in the regeneration process. Suitable inert solids are any refractory material with low coke production properties such as alpha alumina, fused alumina, and low surface area clays. Material and methods for recycling inert solids in FCC processes are further described in U.S. Pat. No. 4,859,313; the contents of which are hereby incorporated by reference.

FCC feedstocks, suitable for processing by the method of this invention, include conventional FCC feeds and higher boiling or residual feeds. The most common of the conventional feeds is a vacuum gas oil which is typically a hydrocarbon material having a boiling range of from 650°–1025° F. and is prepared by vacuum fractionation of atmospheric residue. These fractions are generally low in coke precursors and the heavy metals which can deactivate the catalyst. Heavy or residual feeds, i.e., boiling above 930° F., which have a high metals content, are finding increased usage in FCC units. These residual feeds are characterized by a higher degree of coke deposition on the catalyst when cracked. Both the metals and coke serve to deactivate the catalyst by blocking active sites on the catalysts. Coke can be removed to a desired degree by regeneration and its deactivating effects thereby overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst makeup required to maintain constant activity. The contaminant metals include nickel, iron, and vanadium. In general, these metals affect selectivity in the direction of less gasoline and more coke. Due to these deleterious effects, the use of metal management procedures within or before the reaction zone are anticipated in processing heavy feeds by this invention.

Looking then at the disengaging vessel of FIG. 1, a regenerator conduit 18 passes regenerated catalyst from regenerator 12 into contact with a carbonized catalyst from a conduit 32 at a rate regulated by control valve 20 to create a blended mixture of catalyst. The catalyst mixture is blended in a conduit section containing a chamber 34. The blended mixture of catalyst may be discharged in any manner that will provide a stream of catalyst have a configuration suitable for establishing an ultra short contact time between the feed and catalyst blend. A discharge point may collect the catalyst to supply a falling curtain of catalyst that contacts the feed stream. Designs and methods for controlling the discharge of catalyst are known in the art and may be found in the previously described background references. The stream of catalyst that contacts the feed will usually have a velocity of at least 10 ft/sec.

This higher ratio of catalyst to feed provided by the addition of carbonized catalyst promotes rapid vaporization of the feed and increases the catalyst surface area in contact with the feed to make vaporization more uniform. The greater quantity of catalyst reduces the added heat per pound of catalyst for raising the temperature of the entering feed so that a high feed temperature is achieved with less temperature differential between the feed but with the same amount of heat and more contact area.

The regenerated catalyst will have a substantially higher temperature than the carbonized catalyst. Regenerated catalyst from the regenerated conduit 18 will usually have a temperature in a range from 1100°–1400° F. and, more typically, in a range of from 1200°–1400° F. Once the blended catalyst mixture contacts the feed, as subsequently described, the blended catalyst mixture accumulates additional coke on the catalyst particles and has a lower temperature than the blended mixture upon its return to the recycle vessel 14 as carbonized catalyst. The temperature of the carbonized catalyst will usually be in a range of from 900°–1150° F., but its temperature will vary depending on source. The relative proportions and temperatures of the carbonized catalyst and regenerated catalyst will determine the temperature of the blended catalyst mixture that enters the riser. The blended catalyst mixture will usually range from about 1000°–1400° F., and will more preferably range from 1050°–1250° F. Supplying the heat of reaction for the cracking of the hydrocarbon feed requires a substantial amount of regenerated catalyst to initially contact the feed. Therefore, the blended temperature of the blended catalyst mixture will usually be substantially above the carbonized catalyst temperature. Blending the carbonized and regenerated catalyst in the manner of this invention typically increases the relative amount of catalyst that contacts the feed. The amount of blended catalyst that contacts the feed will vary depending on the temperature of the regenerated catalyst and the ratio of carbonized to regenerated catalyst comprising the catalyst blend. Generally, the ratio of blended catalyst to feed will be in ratio of from 1 to 50. The term "blended catalyst" refers to the total amount of solids that contact the feed and includes both the regenerated catalyst from the regenerator and the carbonized catalyst from that has been already used in a reaction within the process. Preferably, the blended catalyst to feed will be in a ratio of from 10 to 20 and more preferably in ratio of from 10 to 15.

Figure 2:
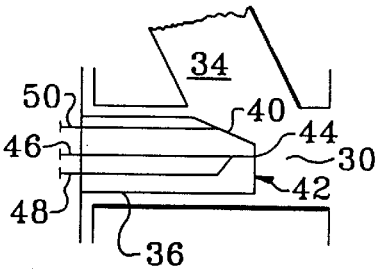
FIG. 2 is an enlarged detail of a feed contacting device shown in FIG. 1.

The blended catalyst mixture passes over the top of a feed injector 36. Steam and the primary feed enter the injection apparatus 36 through a plurality of nozzles generally indicated by numeral 38. As shown more clearly in FIG. 2, feed injection apparatus 36 has a sloped surface 40 over which the blend of catalyst from the conduit section containing chamber 34 passes before falling in front of a contacting face 42 having nozzles 44 for creating a horizontally extended jet or horizontally extended array of jets that inject the feed. As the catalyst slides down sloped surface 40, it falls onto the feed and is carried through inlet 30 into the disengaging vessel 14. Feed entering through a nozzle 46 is mixed with steam that enters the injector 36 via a nozzle 48 ahead of nozzle 44. Additional steam may be added for transport of the catalyst over sloped surface 40 via nozzle 50. The injector shown in FIG. 2 schematically illustrates one form of creating a horizontal jet of feed for contacting catalyst with feed in an ultra short contacting arrangement. Any type of injector for effecting ultra short contacting between feed and catalyst can be used with this invention. Such injectors may shoot the feed in a horizontal or angled direction.

The feed transversely contacts the falling catalyst to obtain a quick contacting between the feed and the catalyst particles. For the purposes of this description, the expression "transversely contacting" means the feed does not flow parallel to the direction of the falling catalyst. The feed injector 36 will produce a spray pattern that is compatible with the geometry of the falling curtain. Where the falling curtain has a linear shape as depicted in the figure, the feed injector will produce a flat horizontal pattern of atomized charge. In any arrangement hydrocarbon feed and catalyst first contact and then the mixture moves rapidly towards a separation device so that the hydrocarbons are separated from the catalyst after a contact time of less than 1 second. Preferably, the feed and catalyst mixture enters a separation device after a contact time of from 0.5 to 0.01 seconds. After the initial contacting, feed may be directed upwardly or downwardly, but it is preferentially directed toward the inlet 30. Accordingly, in a typical arrangement, the feed is discharged across an extended horizontal direction to flow into contact with an essentially vertical curtain of catalyst. When contacting the falling curtain of catalyst, the feed will typically have a velocity of greater than 10 ft/sec and a temperature in the range of from 300°–600° F.

A primary purpose of the disengaging vessel is to provide a rapid separation of catalyst from the initially cracked vapors of the primary feed. As the catalyst and feed initially pass through primary inlet 30, the catalyst drops below the inlet into a dense bed 52 that is maintained in the bottom of the disengaging vessel. The top of dense bed 52 is maintained well below inlet 30 so that the heavier catalyst particles may fall quickly as the rising vapors pass into the upper portion 54 of the disengaging vessel for withdrawal through a primary feed outlet 56 and transfer to a separator 58. Carbonized catalyst recovered from separator 58 drops downwardly into catalyst recycle conduit 32 for blending with regenerated catalyst as previously described. A product line 60 withdraws the primary product from separator 58 for further separation and gas recovery.

Disengaging vessel 14 can also provide an additional stage of carbonized catalyst blending for the further adjustment of the catalyst to oil ratio in riser 16. A recycle conduit 22 passes catalyst from reactor 10 into disengaging vessel 14 at a rate regulated by a control valve 24. Fluidizing gas passed into disengaging vessel 14 by a conduit 26 contacts the catalyst and maintains the catalyst in a fluidized state for transport to inlet 28 of riser 16. However, it is preferable to limit the volume of bed 52 to avoid over cracking of spent and adsorbed hydrocarbons on the catalyst that is separated from the primary feed. The level of blending and back mixing will be both a function of the pipe and volume of bed 52 as well as the volumetric addition of fluidizing gas through conduit 26. The recycle of carbonized catalyst via separator 58, the level of catalyst bed 52, and the addition of fluidizing gas through conduit 26 are all interdependent. The amount of carbonized catalyst recycled to the conduit section containing chamber 34 increases as the fluidizing gas addition and bed level of disengaging vessel 14 are increased. Therefore, the recycle of carbonized catalyst as well as the amount of carbonized catalyst blending performed in bed 52 can be adjusted by varying the level of bed 52 and the addition rate of fluidizing gas to bed 52. The relative locations of feed injector 36, riser 16, and outlet 56 are only shown schematically. The relative locations may be varied as desired to provide clearance for any jet of feed and catalyst extending into disengaging vessel 14 from injector 36. The riser may be offset to accommodate additional clearance, and outlet 56 may be located to most advantageously and quickly recover separated hydrocarbons. Preferably, the level of bed 52 will be kept relatively low to minimize the amount of uncontrolled residence time cracking that occurs on the secondary feed products that are absorbed and entrained on the catalyst in bed 52.

As mentioned, additional carbonized catalyst may be added to the disengaging vessel from conduit 22. Where the feed contacting is effected ahead of the inlet 30 by feed injector 36, all of the catalyst in the disengaging vessel will be carbonized catalyst. The additional amounts of carbonized catalyst added via line 22 to further increase the catalyst to oil ratio in the riser may range broadly from 0 to 100 wt-% of the catalyst entering via inlet 30. More typically this amount of catalyst will be in the range of 20 to 50 wt-%. Of course one of the flexibility advantages of this process is that ultra short contacting may be eliminated when desired and all of the feed contacting can be accomplished in the riser. For such cases, conduit 22 can again supply all of the carbonized catalyst to contact the feed with a blend of carbonized and regenerated catalyst. Ordinarily the ratio of carbonized catalyst to regenerated catalyst entering the blending zone will be in a broad range of from 0.1 to 5, and will more typically range from 0.5 to 1.0. Methods for such contacting and blending are more fully disclosed in U.S. Pat. No. 5,451,313, the contents of which are hereby incorporated by reference.

The carbonized catalyst recycled by to chamber 34 by the conduit or the disengaging vessel 14 by line 22 or from inlet 30 comprises a random mixture of particles having varying degrees of coke ranging from particles that have made several cycles through the reaction zone and, thus, contain a heavy coke concentration to particles that have only passed once through the reaction zone since regeneration. It is, of course, more desirable to recycle those particles that have had a shorter residence time on the reactor side of the process and to regenerate those particles that have had the most cycles through the reaction zone and, thus, have the heaviest loading of coke. Since the particles with the lightest loading of coke tend to be lower density, they are preferentially carried into cyclone 58 with the primary product. The heavier catalyst particles, as previously mentioned, have a tendency to drop out first and land directly in bed 52.

From a blending standpoint, maintaining dense phase conditions in the disengaging vessel 14 greatly increases heat transfer between the catalyst particles. The dense phase conditions are characterized by a dense catalyst bed which is defined as having a density of at least 10 lbs/ft$^3$ and, more typically, a density of from 20 to 50 lbs/ft$^3$. In order to maintain turbulent conditions within the blending vessel, conduit 26 may represent one or more streams of a fluidizing medium enter the vessel directly or through a manifold. The fluidizing gas may be a diluent stream of inert material that enters the bottom of the blending vessel. In the arrangement shown by FIG. 1, most of the fluidization material entering via conduit 26 will pass with primary products out of the disengaging vessel through outlet 56. Therefore, inert materials are preferred for fluidization purposes. Fluidization gas passes through the blending zone at a typical superficial velocity of from 0.2 to 3 ft/sec. A turbulent regime can be established in dense bed 52 to fully blend recycle catalyst from conduit 22 with catalyst from inlet 30. In this manner, blending vessel 14 supplies a blended catalyst mixture to the bottom of riser 16.

The amount of coke on the carbonized catalyst passed to the disengaging vessel will vary depending on the total residence time of specific catalyst particles that pass from the blending vessel to the different contacting zones and back to the disengaging vessel within the process loop. Since the separation of catalyst particles out of the riser is random, some catalyst particles may have a long residence time within the reactor vessel before entering the regeneration zone. Nevertheless, the spent catalyst entering the regeneration zone as well as the carbonized catalyst will typically have an average coke concentration of between 0.7 to 1.25 wt-%.

Riser 16 provides a conversion zone for cracking of the residual feed hydrocarbons. These hydrocarbons are usually of higher molecular weight than the hydrocarbons that were initially cracked by the initial ultra short contacting. These molecular weight hydrocarbons are slower to vaporize and more easily retained in and upon the catalyst. Contacting these hydrocarbons at a high catalyst to oil ratio has the advantage of increasing severity and conversion with a net reduction of clarified oil to more valuable hydrocarbons.

Riser 16 is one type of conversion zone that can be used in conjunction with the blending zone of this invention. The controlled secondary contacting may also take place in a downflow catalyst conduit that withdraws catalyst from the bottom of the disengaging vessel. In a riser type arrangement, the riser conduit has a smaller diameter than the blending vessel so that the riser will fit in the disengaging vessel and provide the necessary clearance for primary product and catalyst separation.

A fluidization material enters the inlet 28 of the riser 16 through a nozzle 62. Nozzle 62 may carry a secondary feed as well as fluidizing material into riser 16. Preferred secondary feed will comprise light cycle oil, heavy cycle oil, and heavy naphtha streams. The riser above the point of fluidization material injection typically operates with dilute phase conditions wherein the density is usually less than 20 lbs/ft$^3$ and, more typically, is less than 10 lbs/ft$^3$. A secondary feed may also be introduced into the riser somewhere between inlet 28 and substantially upstream from an outlet 30 through an inlet nozzle 66. Volumetric expansion resulting from the rapid vaporization of the any feed that enters the riser further decreases the density catalyst within the riser to typically less than 10 lbs/ft$^3$. Injection of the secondary feed downstream of inlet 28 is preferred to avoid adding feed where the backmixing and poor distribution during the initial acceleration catalyst in the conduit can adversely affect the feed contacting.

The blended catalyst mixture and additional reacted feed vapors are then discharged from the end of riser 16 through an outlet 30 and separated into a product vapor stream and a collection of catalyst particles covered with substantial quantities of coke and generally referred to as spent catalyst. A separator, depicted by FIG. 1 as cyclones 68, removes catalyst particles from the secondary product vapor stream to reduce particle concentrations to very low levels. Cyclone separators are not a necessary part of this invention. This invention can use any arrangement of separators to remove spent catalyst from the product stream. In particular, a swirl arm arrangement provided at the end of riser 16 can further enhance initial catalyst and cracked hydrocarbon separation by imparting a tangential velocity to the exiting catalyst and converted feed mixture. Such swirl arm arrangements are more fully described in U.S. Pat. No. 4,397,738; the contents of which are hereby incorporated by reference. Product vapors comprising cracked hydrocarbons and trace amounts of catalyst exit the top of reactor vessel 10 through conduits 70. Catalyst separated by cyclones 68 return to the reactor vessel through dip leg conduits 72 into a dense bed 74.

Primary and secondary products are typically transferred to a separation zone for the removal of light gases and heavy hydrocarbons from the products. Product vapors enter a main column (not shown) that contains a series of trays for separating heavy components such as slurry oil and heavy cycle oil from the product vapor stream. Lower molecular weight hydrocarbons are recovered from upper zones of the main column and transferred to additional separation facilities or gas concentration facilities.

Catalyst drops from dense bed 74 through a stripping zone 76 that removes adsorbed hydrocarbons from the surface of the catalyst by countercurrent contact with steam. Steam enters the stripping zone 76 through a line 78. Spent catalyst stripped of hydrocarbon vapors leave the bottom of stripping zone 76 through a spent catalyst conduit 80 at a rate regulated by a control valve 82.

Carbonized catalyst for transfer to the disengaging vessel or injector 36 may be withdrawn from the disengaging vessel, stripper vessel or even reactor riser. Carbonized catalyst from riser 16 is typically withdrawn downstream of the reactor riser and, more typically, is withdrawn from the stripping zone. FIG. 1 depicts the withdrawal of carbonized catalyst from an upper portion of the stripping zone 76. The recycle catalyst conduit 22 transfers one portion of the spent catalyst exiting riser 16 back to the disengaging vessel as a recycle of carbonized catalyst. Another portion of the spent catalyst is transported to the regeneration zone for the removal of coke.

The process can use any type of regeneration for the removal of coke. Coke removal from the regenerated catalyst will ordinarily operate to completely remove coke from catalyst is generally referred to as "complete regeneration". Complete regeneration produces a catalyst having less than 0.1 and preferably less than 0.05 wt-% coke. In order to obtain complete regeneration, oxygen in excess of the stoichiometric amount necessary for the combustion of coke to carbon oxides is charged to the regenerator. Excess oxygen charged to the regeneration zone will react with carbon monoxide produced by the combustion of coke, thereby yielding a further evolution of heat. Different arrangements and means for operating of regenerators are known to effect combustion of CO to various degrees and the removal of any excess heat. Heat must be controlled because there are limitations to the temperatures that can be tolerated by FCC catalyst without having a substantial detrimental effect on catalyst activity. Generally, with commonly available modern FCC catalyst, temperatures of regenerated catalyst are usually maintained below 760° C. (1400° F.), since loss of activity would be very severe at about 760°–79°0 C. (1400°–1450° F.). If a relatively common reduced crude such as that derived from Light Arabian crude oil were charged to a conventional FCC unit and operated at a temperature required for high conversion to lighter products, i.e., similar to that for a gas oil charge, the regenerator temperature would operate in the range of 870°–980° C. (1600°–1800° F.), therefore some heat removal is normally required for the processing of heavy feeds.

In the regeneration process depicted by FIG. 1, conduit 80 transfers spent catalyst to a combustor style regenerator 12 at a rate regulated by a control valve 82. The spent catalyst undergoes the typical combustion of coke from the surface of the catalyst particles by contact with an oxygen containing gas. The oxygen containing gas enters the bottom combustor 81 of the regenerator via an inlet 84 and maintains a fast fluidized zone in the combustor. The fast fluidized conditions establish an upward catalyst transfer velocity of between 8 to 25 ft/sec in a density range of from 4 to 34 lbs/ft$^3$. Combustion of coke from catalyst particles continues through an internal riser (not shown) that transfers catalyst to an upper disengaging vessel 83. Residence time through the combustor and riser will usually provide sufficient reaction time to completely combust coke and fully regenerate the catalyst, i.e. removal of coke to less than 0.2 wt-% and preferably less than 0.1 wt-%. Catalyst discharged from the riser passes through a dense fluidizing bed of catalyst (not shown). Flue gas consisting primarily of CO or $CO_2$ passes upward and enters disengaging vessel 83 of regenerator 12. A separator, such as the cyclones previously described for the reactor vessel or other means, remove entrained catalyst particles from the rising flue gas before the flue gas exits the vessel through an outlet 86. Combustion of coke from the catalyst particles raises the temperatures of the catalyst to those previously described for catalyst withdrawn by regenerator standpipe 18. In addition, the combustor style regenerator usually effects a complete combustion of CO to $CO_2$. Flue gases exit the regenerator through an outlet nozzle 86. A portion of the catalyst contained in the disengaging vessel 83 may be recirculated back to the combustor through a line 85 at a rate regulated by a control valve 87. The remainder of the regenerated catalyst is returned to the blending vessel via line 18.

Figure 3:
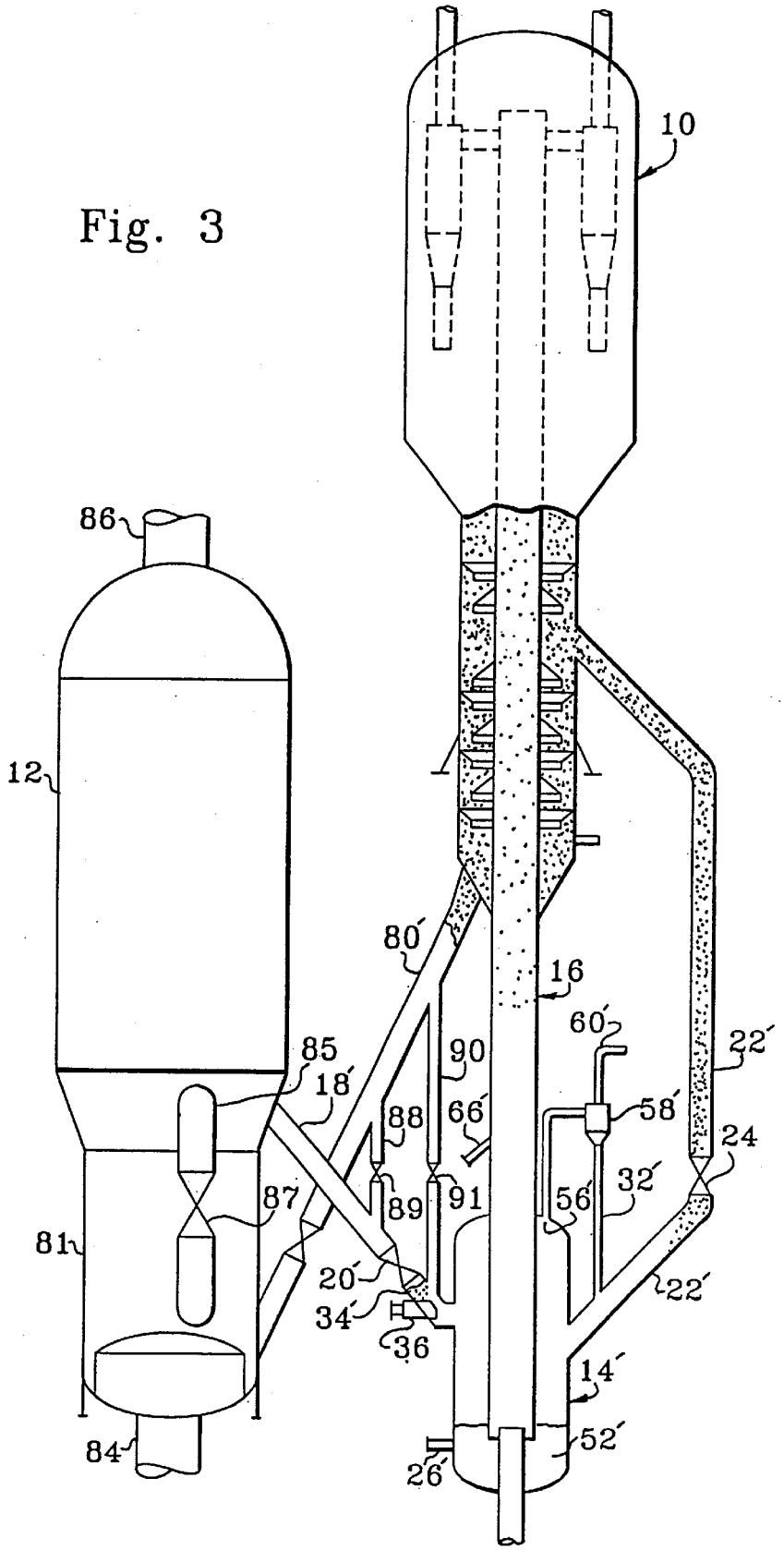
FIG. 3 is an elevation view showing a modified cross section of the disengaging vessel relative to FIG. 1.

FIG. 3 shows another arrangement for an FCC unit arranged in accordance with the process and apparatus of this invention. The same reference numerals are shown to describe similar items in both FIG. 1 and FIG. 3. This arrangement shows a modified blending vessel 14' at the lower part of riser 16 which passes a mixture of blended catalyst and cracked hydrocarbons to a reactor vessel 10 which is arranged with a recycle conduit 22' and chamber 34' that all operate in the manner aforementioned in conjunction with FIG. 1 except as specifically described otherwise.

Regenerated catalyst from a line 18' at rate regulated by a control valve 20' is mixed with carbonized catalyst recycled from line 80'. Carbonized catalyst may be transferred for blending into conduit 18' by either of conduits 88 or 90. The flow of recycled catalyst may be controlled in lines 88 and 90 by valves 89 and 91, respectively. A typical commercial arrangement will contain one or the other of lines 88 or 90. Line 88 has the advantage of providing a longer mixing and residence time between the regenerated catalyst and the recycled carbonized catalyst before it contacts feed from injector 36. The arrangement of FIG. 3 differs from FIG. 1 primarily by the direct recycle of carbonized catalyst from the stripping section via conduit 80' and either or both of conduits 88 and 90.

The arrangement of FIG. 3 also differs from that of FIG. 1 by the return of carbonized catalyst from the top of disengaging vessel 14' through an outlet 56'. A separator 58' receives the catalyst and primary products from the disengaging vessel and returns separated catalyst for direct recycle into disengaging vessel 14' via recycle conduits 32' and 22'. Primary products are recovered overhead from the separator via a conduit 60'. Line 60' will be operated to withdraw at least a portion of the fluidizing gas that enters disengaging vessel via conduit 26. This insures that all of the primary products are withdrawn via line 60' and are not passed into riser conduit 16 for further cracking. The arrangement of FIG. 3 de-couples the circulation of carbonized catalyst to the primary contacting zone from the operation of the disengaging vessel. Accordingly, the separator loading and resulting recycle rate of catalyst through conduit 32' and 22' do not effect the amount of catalyst that enters standpipe 18'. Therefore, the level of bed 52' and the amount of fluidizing gas entering via conduit 26' may be controlled independently of the recycle rate of carbonized catalyst to the primary feed contacting zone.

Disengaging vessel 14, 14' can provide a number of functions in addition to catalyst disengagement. For example, the disengaging vessel can be used as an added stage of stripping and provides a particularly beneficial use of the vessel. The blending of regenerated catalyst typically elevates the temperature of the blended catalyst so that a stripper-blending zone provides hot stripping. Aside from product recovery the blending zone can strip entrained inert gases that accompany the catalyst from the regeneration step, from the catalyst.

The reactor and regenerator arrangement shown in FIG. 1 and FIG. 3 may also benefit from external heat removal. Such external heat recovery systems include well known arrangements such as catalyst coolers that remove heat by indirect heat exchange. Where a catalyst cooler is employed, it will typically receive catalyst from and return catalyst to the regenerator side of the process where temperatures are the highest. The higher temperatures associated with the regenerator side of the process ordinarily improve the efficiency of the heat removal apparatus. However, catalyst entering the disengaging vessel may also circulate through a heat exchanger for heat recovery. Accordingly, catalyst for cooling may exit either the regeneration zone or the disengaging zone and return either to the regeneration zone or the disengaging zone.

What is claimed is:

1. An apparatus for the fluidized catalytic cracking of hydrocarbons, said apparatus comprising:

a) a disengaging vessel having a first diameter and defining a primary feed inlet in its sidewall;

b) a riser conduit defining a riser inlet in communication with the interior of said disengaging vessel at one end and an outlet at its opposite end, said riser conduit having a second diameter that is smaller than said first diameter, said riser inlet located below said primary feed inlet and a fluidizing gas nozzle located proximate said riser inlet;

c) a regenerator vessel in communication with a first standpipe conduit for supplying regenerated catalyst to said primary feedstream inlet;

d) means for mixing regenerated catalyst from said first standpipe conduit with carbonized catalyst and injecting the mixture of regenerated and carbonized catalyst along with a primary feedstream into said primary feed inlet;

e) a primary product outlet defined by said disengaging vessel at a location above said primary feed inlet;

f) a first separator for receiving a primary product stream from said disengaging vessel, separating carbonized catalyst from said primary product stream and returning carbonized catalyst to said disengaging vessel via a first recycle conduit;

g) a second separator for receiving a secondary product stream from said riser and separating carbonized catalyst from said secondary product stream and passing carbonized catalyst to a stripping vessel;

h) a second standpipe conduit for passing carbonized catalyst from said stripping vessel to said disengaging vessel; and, i) means for passing carbonized catalyst particles to said regenerator to regenerate catalyst particles.

2. The apparatus of claim 1 wherein said means for mixing includes means for admitting a fluidizing gas into said vessel.

3. The apparatus of claim 1 wherein means are provided for injecting a secondary feedstream into said riser conduit at a location between said inlet and said outlet of said riser.

4. The apparatus of claim 1 wherein said means for injecting a secondary feedstream into riser conduit is located above said disengaging.

5. The apparatus of claim 1 wherein said recycle conduit returns carbonized catalyst to disengaging vessel via said means for mixing.

6. The apparatus of claim 1 wherein said means for mixing includes means for dropping the mixture of regenerated and carbonized catalyst on a horizontal jet of said primary feedstream.

* * * * *